US005182898A

United States Patent [19]

Tung et al.

[11] Patent Number: 5,182,898

[45] Date of Patent: Feb. 2, 1993

[54] BAGGING SPECIFICATION ADJUSTMENT AND AUTOMATIC INWARD-CONTRACTION AND OUTWARD-EXPANSION MECHANISM FOR BAGGING MACHINE

[75] Inventors: Fu-Ching Tung; Chi-Tsun Chen; Sheng-Feng Lieu, all of Hsinchu, Taiwan

[73] Assignee: Industrial Technology Research Institute, Hsinchum, Taiwan

[21] Appl. No.: 791,032

[22] Filed: Nov. 12, 1991

[51] Int. Cl.[5] ..... B65B 43/16

[52] U.S. Cl. ..... 53/570; 53/384.1; 493/475; 493/479

[58] Field of Search ..... 53/384.1, 386.1, 393, 53/573, 571, 570; 493/479, 478, 475, 473

[56] References Cited

U.S. PATENT DOCUMENTS

| | | | |
|---|---|---|---|
| 2,054,279 | 9/1936 | Briggs | 53/384.1 |
| 2,899,786 | 8/1959 | Harker | 53/384.1 |
| 4,108,300 | 8/1978 | Hayase et al. | 53/386.1 X |
| 4,956,964 | 9/1990 | Jones et al. | 53/386.1 |

FOREIGN PATENT DOCUMENTS

| | | | |
|---|---|---|---|
| 2650807 | 2/1991 | France | 53/384.1 |

*Primary Examiner*—James F. Coan
*Attorney, Agent, or Firm*—Bucknam and Archer

[57] ABSTRACT

An adjustment and automatic inward-contraction and outward-expansion machanism, and particularly a single mechanism that provides the function of variable specification adjustment as well as automatic inward-contraction and outward-expansion of the claw arms during operation is described. The mechanism includes a worm provided for driving the worm gear and other related devices in rotation so that a cylindrical groove cam is engaged in motion up and down. With the cylindrical groove cam in motion up and down and further by means of L-type steering block, push and pull rod and four-bar linkage, claws are provided for specification adjustment. During the operation of the machine and when the roller of the plunge rod under L-type steering block is in rotation along the groove of the cylindrical groove cam, due to the undulations of groove, the plunge rod is in motion up and down and causes the contraction and expansion of the claw arms by means of the L-type steering block, the push and pull rod and the four-bar linkage, so as to meet the requirement of expanding the mouth of the bag and the operations prior to the sealing treatment. The present mechanism not only can adjust the distance between the claw arms subject to the specification of the bag directly by means of the worm but also can perform the function of automatic contraction and expansion of the claw arms when the bag is properly located at a specific position so as to cooperate with the external structure for the preformance of expanding the mouth of the bag, charging the bags and the thermal sealing treatment.

2 Claims, 5 Drawing Sheets

BAGGING SPECIFICATION ADJUSTMENT AND AUTOMATIC INWARD-CONTRACTION AND OUTWARD-EXPANSION MECHANISM FOR BAGGING MACHINE

BACKGROUND OF THE INVENTION

This invention relates to a bagging specification adjustment and automatic inward-contraction and outward-expansion mechanism for a machine for packaging material in bags and particularly to a single mechanism that can adjust the distance between the claw arms subject to the specification of the mouth of the bag. During the operation, it also permits the claw arms to form an automatic inward contraction at a specific position and together with the external vacuum sucking pads allows the mouth of the bag to expand during the charging phase. Upon the completion of the charge, the claw arms expand outwardly to allow the mouth of the bag to collapse for thermal sealing treatment.

To match the specification of the mouth of the bag in the conventional disc-type bagging machine, typically the claw arms are constructed as shown in FIG. 1 according to ROC Pat. 147095 with an appropriate numbers of screw and screw hole thereon and claws removably mounted. Wishing to adjust the machine in accordance with the specification of the bags, one has to unlock each screw station to station. In FIG. 1, there are six stations having a total of 12 claw arms and 24 pieces of screws and it is necessary to dismount these 12 claws for relocation corresponding to the specification of the bags. In addition to the trouble of complicated dismounting, this construction is adjustable to fit a limited range of specifications.

In addition, for the charging operation, the conventional machines need to pull the claw arms with a pneumatic cylinder or similar equipment and together with the vacuum sucking pads on each side of the bag respectively for sucking each side of the mouth so as to force it to expand. At the end of the charging operation, some method is needed to force the mouth to collapse gradually for the subsequent thermal sealing treatment.

SUMMARY OF THE INVENTION

One object of the present invention is to provide an adjustment and automatic inward-contraction and outward-expansion mechanism for the packaging machine that is applicable to the bags of various specifications subject only to the operation of the worm, and more specifically a device for variable specification adjustment as well as automatic inward-contraction and outward-expansion of the claw arms by means of a groove and mounted support roller whereby the mouth of the bags can be expanded at the due time depending on the contraction of the claw arms together with the force of vacuum sucking pads to meet the requirements of the charging operation. On the other hand, the expansion of the claw arms forces the mouth of the bag to collapse gradually to facilitate thermal sealing treatment so that both the specification adjustment and other operations necessary for packing can be carried out by means of the present mechanism.

The mechanism according to the invention achieves the object of specification adjustment simply by rotating the worm whereby the distance between the claw arms at each station (the embodiment of the invention shown having total 10 stations) is adjusted simultaneously and also their synchronous contraction and expansion are accomplished without necessity of adjustment one after another. A groove cam mechanism is provided for the support roller of the plunge rod in rotation along a groove which drives a linkage in motion at a specific moment and location whereby the claw arms are engaged in automatic contraction inwardly corresponding to the expansion of the mouth of the bags and in expansion outwardly in response to the gradual collapse of mouth of the bags prior to the thermal sealing treatment.

These and other objects and advantages of this invention will become apparent to those skilled in the art after considering the following detailed specification together with the accompanying drawings wherein:

DETAILED DESCRIPTION OF PREFERRED EMBODIMENTS

Figure 1:
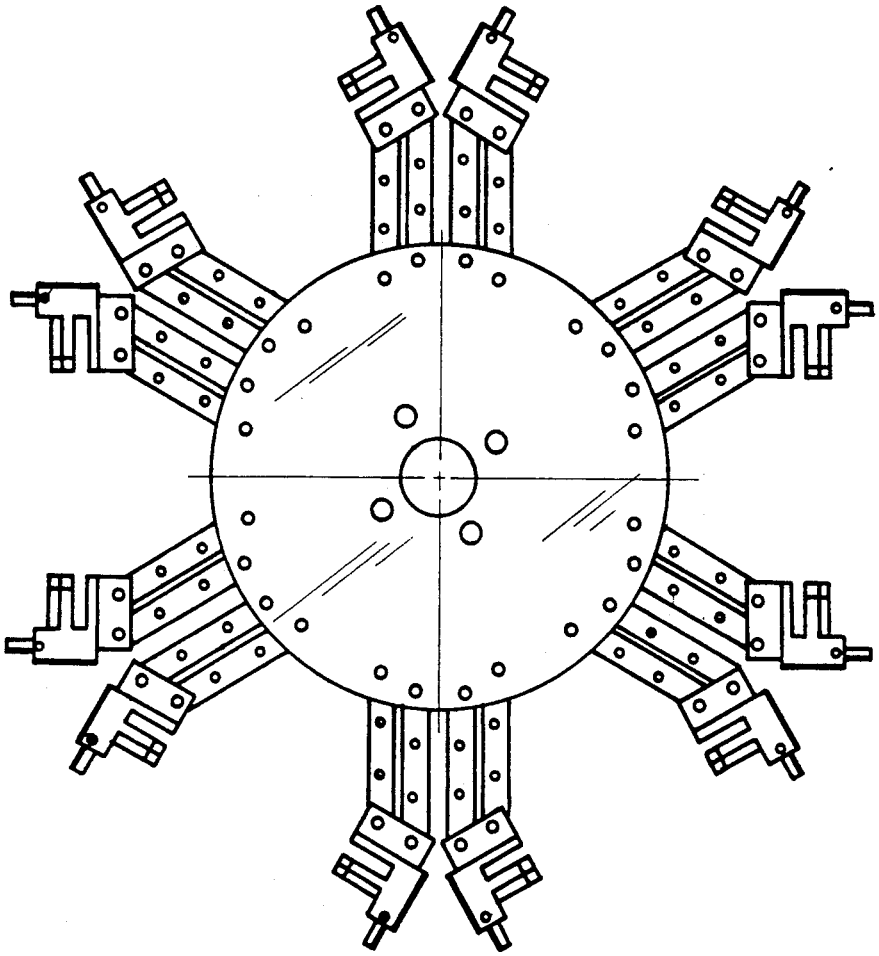
FIG. 1 is a top view showing the structure of a conventional bagging machine.
Figure 2:
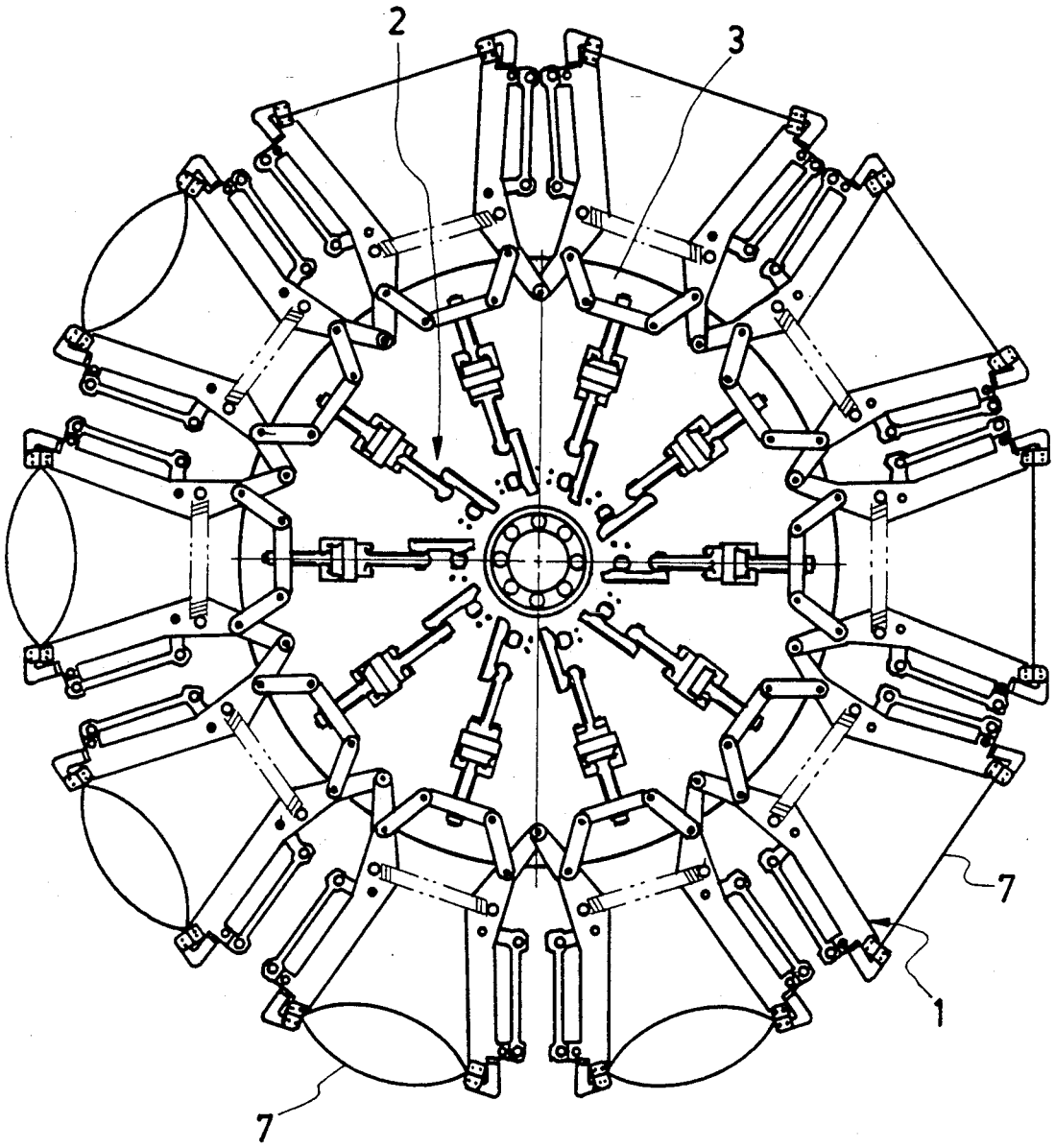
FIG. 2 is a top view showing the embodiment of the claws applied to 10 stations of the invention.
Figure 3:
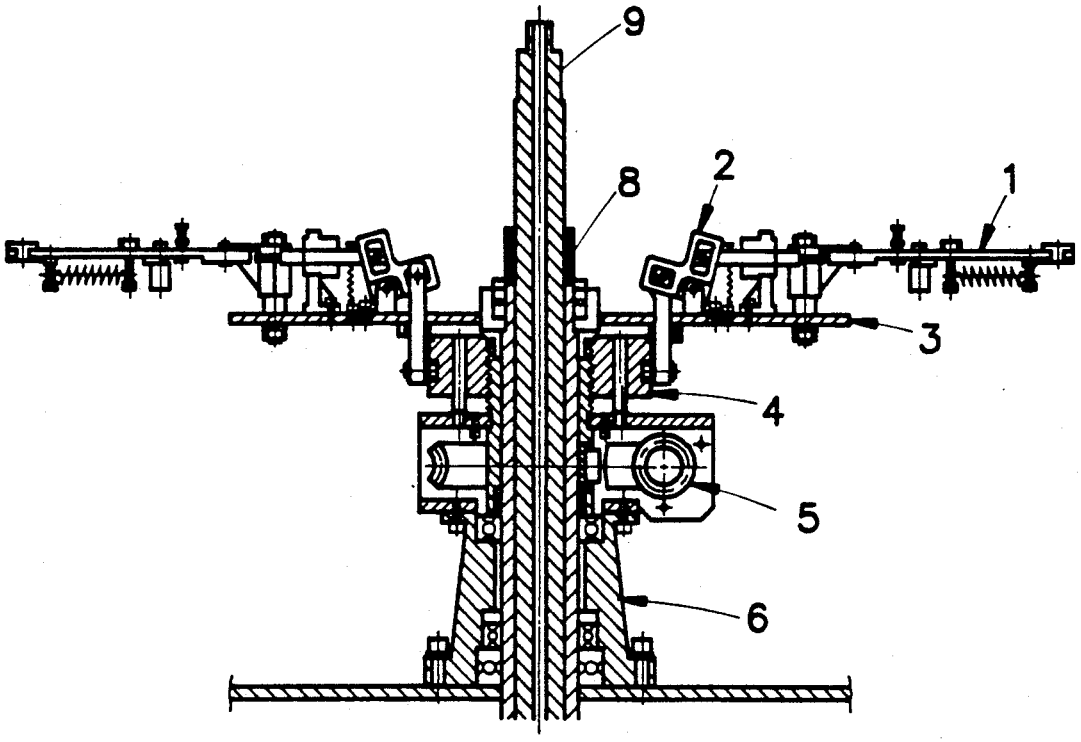
FIG. 3 is a front view of the embodiment of the invention.

Referring to FIGS. 2 and 3, this invention comprises: a claw mechanism 1, a steering mechanism 2, a claw support mechanism 3, a groove cam mechanism 4, a worm and gear mechanism 5 and a main support base 6.

Figure 4:
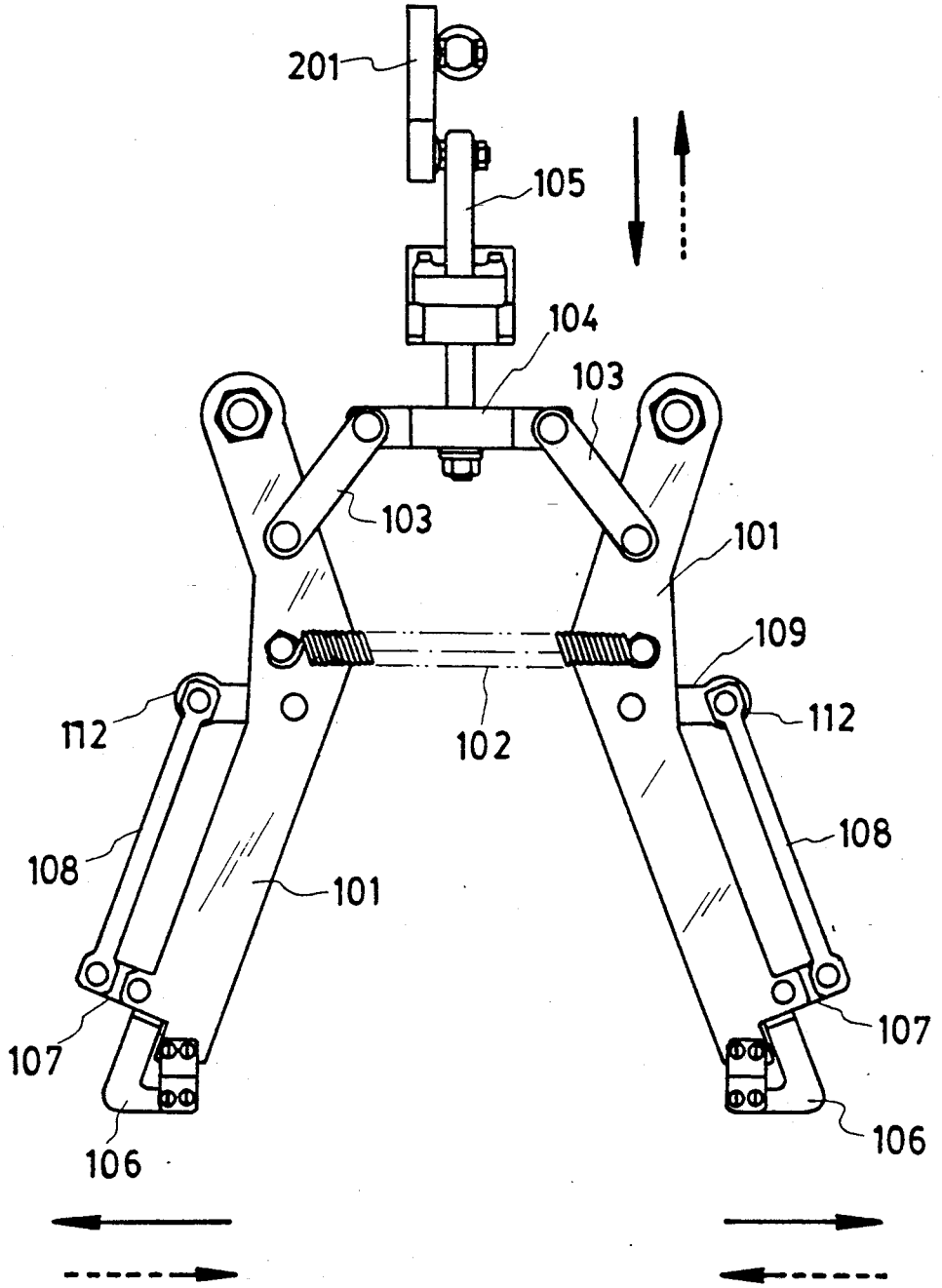
FIG. 4 is a top view showing the embodiment of the claws of the invention.

Referring to FIG. 4, the claw mechanism 1 includes claw arms 101, spring 102, coupling rods 103, driving rods 104, push and pull rod 105. When the push and pull rod 105 moves forward to push the driving rods 104 of the four-bar linkage structure and coupling rods 103, the pair of claw arms 101 is forced to expand outwardly as indicated by the direction of the arrows shown in FIG. 4. When the push and pull rod 105 reverses, the driving rods 104 of the four-bar linkage as well as the coupling rods 103 are pulled to force the pair of claw arms 101 to contract inwardly as indicated by the direction of arrow shown in FIG. 4, and the claw arms 101 support the four-bar linkage 107, 108 and 109. When the push plate of the external structure drives the driving roller 112 (FIG. 5) to gear up the four-bar linkage 107, 108 and 109, the claws 106 open and release the bag 7 and at another station, the claws 106 close and hold the bag 7. In other words, when the bag 7 is picked up with claws 106 at station 1, a bag feed mechanism (an external structure constructed according to prior art), it moves clockwise in a cyclic manner and stays at each station until the completion of action in the respective station. For instance, it starts moving from station 1 to be opened at station 3, charged at station 4, thermally sealed at station 8 and released at station 10 while the claws are open, as shown in FIG. 2. When the mouth of the bag is elliptically formed at station 3, since the circumference of mouth of bag is maintained the same, the claw arms 101 have to contract inwardly so as to let the mouth of the bag to be elliptically formed. Likewise, when the bag already charged is ready for the thermal sealing treatment at station 8 by means of the thermal sealing plate (not shown), the mouth of the bag has to be pulled straight so that it can be sealed in a perfect manner. In this case, the claw arms 101 have to expand outwardly in order to pull straight the mouth of the bag before arrival at station 8. If the specification of the bag is changed, the distance between the claw arms 101 must be adjusted by means of inward contraction or outward expansion depending on the width of bag before starting the machine operations.

Figure 5:
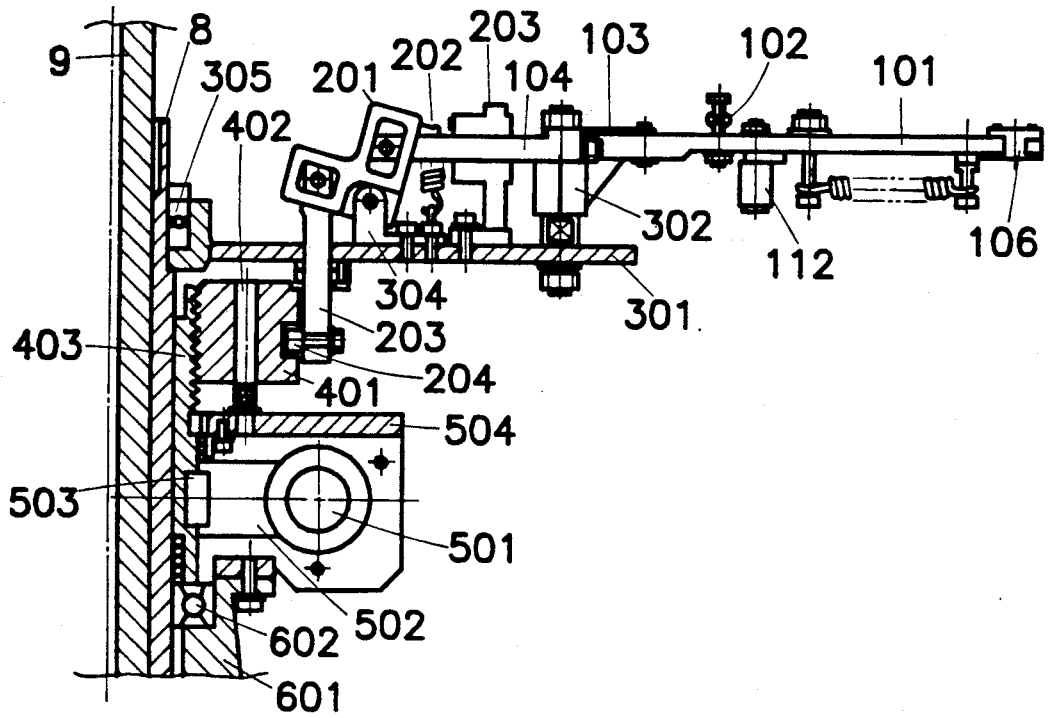
FIG. 5 is a partially detailed view of the embodiment of the invention.
Figure 6:
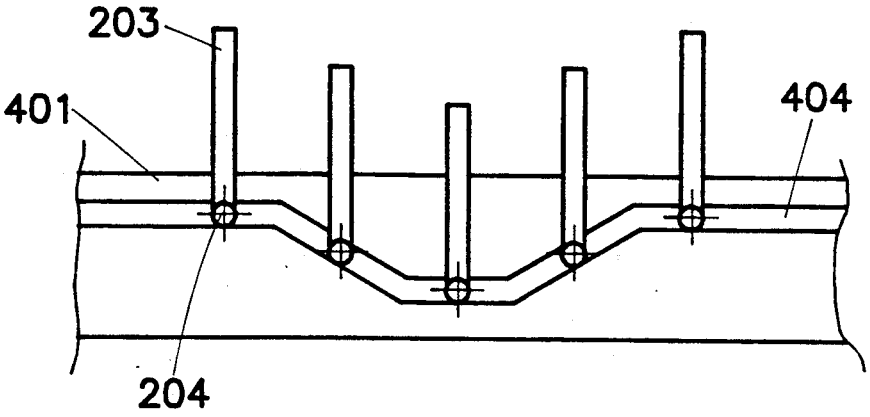
FIG. 6 is a view of the embodiment of the cylindrical cam groove of the invention.

The steering mechanism 2 shown in FIG. 5 includes the L-type steering block 201, a reversing spring 202, a plunge rod 203, a support roller 204. When the support roller 204 is dragged, the plunger rod 203 is driven in motion up and down. When the plunge rod 203 goes up and diverts by means of the L-type steering block 201, the push and pull rod 105 is driven forward to force the claw arms 101 to expand outwardly. However, when the plunge rod 203 descends, the push and pull rod 105 reverses to force the claw arms 101 to contract inwardly.

The claw support mechanism 3 includes the strut 302 provided for supporting the claw mechanism 1 and as a rocking center shaft for the claw arms 101, guide 303 provided for maintaining push and pull rod 105 in plunging motion. Rocking shaft seat 304 is provided for supporting L-type steering block 201 in rocking motion. The support plate 301 provided for supporting the entire claw mechanism 1 and the steering mechanism 2 is integrally connected with the hollow shaft 8 by means of clamping ring 305 to permit the hollow shaft 8 to rotate around shaft 9 at an appropriate angle perfectly to stop at each station until the necessary operations are completed.

The groove cam mechanism 4 includes cylindrical groove cam 401, guide rod 402, thread rod 403, as shown in FIG. 5. Being secured to the frame (shown in the drawing is casing box 504) by means of guide rod 402, the cylindrical groove cam 401 is placed in motion only up and down. The motion is due to the thread shaft 403 being driven by worm gear 502. When the support rollers 204 are in rotation within the groove around the cylindrical groove cam 401 to reach a level degree, the plunge rod 203 maintains uniform height. When the roller 204 is rolling down along a slope, the descent of the plunge rod 203 results in the reverse of push and pull rod 105, the inward contraction of the claw arms 101 at the right moment when the bag is located at station 3 where a pair of vacuum sucking pads are provided for sucking each side of the bag and therefore the mouth of bag is elliptically formed. When roll 204 ascends a slope, the bag is located perfectly in front of the thermal sealing treatment at station 8 where the elevation of plunge rod 203 results in push and pull rod 105 moving forward. The claw arms 101 expand outwardly to let the mouth of the bag to collapse appropriately for thermal sealing treatment.

The worm and gear mechanism 5 includes worm 501, worm gear 502, key 503, casing box 504. When the worm 501 is rotated by hand or a motor, worm gear 502 is driven and power is transmitted by means of key 503 to drive thread shaft 403 in rotation which gears up the entire cylindrical groove cam 401 moving up and down on thread shaft 403. When cylindrical groove cam 401 goes up, the support roller 204 at the respective 10 station goes up accordingly and therefore at each station where plunge rod 203 goes up, the push and pull rod moves forward and the claw arms expand outwardly in response to the wider specification of bag. On the contrary, when the entire cylindrical groove cam 401 descends at respective 10 stations the support roller 204 descends and also the plunge rod 203 descends accordingly, so that the claw arms 101 contract inwardly corresponding to the smaller width of the bag. If a motor is provided, the worm 501 can be driven by a motor for specification adjustment. Further if a control circuit for the motor in connection with a push button is provided, the specification adjustment for bag at 10 stations can be accomplished simply by pushing down the button.

The main support base 6 includes strut 601 and bearing 602. The strut 601 supports the worm and gear mechanism 5 and the support plate 301. The hollow shaft 8 is retained by clamping ring 305 for rotating around shaft 9 whereas the hollow shaft 8 is supported by bearing 602.

Therefore this invention resides in a worm 501 driven by hand (or motor) in rotation that gears up thread shaft 403 in rotation so that the cylindrical groove cam 401 moves up and down. The groove 404 of the cylindrical groove cam 401 drives the plunge rod 203 of the support roller 204 to move up and down and to force the push and pull rod 105 to move forward or in reverse subject to the function of the L-type steering block 201. The push and pull rod 105 drives the claws 106 of the claw arms 101 to contract inwardly or expand outwardly so as to accomplish the object of specification adjustment. When specification adjustment is accomplished, worm 501, worm gear 502, thread shaft 403 and the cylindrical groove cam 401 stop while the worm gear 502 provides non-return function but the hollow shaft 8 keeps on driving the claw arms base at the respective 10 stations in rotation. The support roller 204 in connection with claw arms rotates along the groove 404 accommodated in the cylindrical groove cam 401. When roller 204 rotates at down slope, the plunge rod 203 descends and the push and pull rod 105 reverses to result in inward contraction of claw arms 101 perfectly matching the opening of the bag with vacuum sucking pads. Before the bag arrives to the thermal sealing station, the support roller 204 moves up to the level portion of groove 404 so that the push and pull rod 105 moves forward to result in outward expansion of claw arms 101 and collapse of the mouth of the bag.

Referring to above-mentioned description the present mechanism is characterized in that:

a groove cam mechanism 4 is placed in motion up and down due to the fact that it is radially mounted on the shaft of vertical disc-type packing machine, having groove 404. The hollow shaft 8 is mounted on cocentric shaft of mechanism 4. The latter has claw support mechanism 3, claw mechanism 1 and steering mechanism 2 thereon. When the groove cam mechanism 4 is placed in motion up and down, it forces the plunge rod 203 to push or pull the steering mechanism 2. The steering mechanism 2 gears up the claw mechanism 1 to result in contraction or expansion of the claw arms 101 so that the distance between the claw arms 101 is adjusted to fit the specification of the bag 7. When hollow shaft 8 is in rotation to drive the claw support mechanism 3 in rotation, the support roller 204 of plunge rod 203 on the steering mechanism 2 is rolling up and down along groove 404 in accordance with the undulation therein to gear up the respective mechanism on plunge rod 203 whereby the claw arms 101 are forced to expand or contract, and together with the external structure of the filling device the operation of opening the mouth of the bag, charge and thermal sealing treatment can be accomplished.

The cylindrical groove cam 401 that provides groove 404 for plunge rod 203 moving up and down therein to result in inward contracting or outward expansion of the claw arms 101, may have other means to achieve this object, such as a slide rail in place of the groove 404, which can also provide a basis for inward contraction or outward expansion of claw arms 101.

While the invention has been particularly shown and described with reference to the preferred embodiments thereof, it will be understood by those skilled in the art that various changes in form and detail may be made therein without departing from the spirit and scope of the invention.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. An apparatus for packaging materials into bags, wherein each bag is picked up at one station, opened at a successive station, filled with a material at another successive station, thermally sealed and then released at successive stations which comprises in combination a frame (504), a main support base (6), a worm and gear mechanism (5), a groove cam mechanism (4), a claw support mechanism (3), a steering mechanism (2), a claw mechanism (1), a feeding means and a thermal sealing means, said main support base (6) comprising a first strut (601), a bearing (602) and shaft (9), said worm and gear mechanism comprising a worm (501) and a worm gear (502), said groove cam mechanism (4) comprising a cylindrical groove cam (401) with groove (404), a guide rod (402) and thread rod (403), said guide rod (402) being secured to said frame (504), the claw support mechanism (3) comprising a second strut (302), guide (303), support plate (301), rocking shaft seat (304) and clamping ring (305), the steering mechanism (2) comprising steering block of L-shape (201), spring (202), a plunger rod (203) and support roller (204), the claw mechanism (1) comprising claw arms (101), spring (102), coupling rods (103), driving rod (104), push and pull rod (105), bar linkage (107, 108, 109, 112), said plunger rod (203) being connected to said push and pull rod (105), a hollow shaft (8), said frame (504) supporting the groove cam mechanism (4), said first strut (601) supporting the worm and the gear mechanism (5) and said support plate (301) of said claw support mechanism (3), said bearing (602) supporting said first hollow shaft (8), said hollow shaft (8) being connected to said support plate (301), said hollow shaft (8) being retained by said clamping ring (305) for rotation around said shaft (9), said second strut (302) supporting the claw mechanism (1), said guide (303) maintaining said push and pull rod (105) in motion, said seat (304) supporting said L-shape steering block (201), said worm (501) being connected to said thread shaft (403) whereby when the worm (501) is rotated, it drives said worm gears and said thread shaft (403), it drives said worm gear (502) and said thread shaft (403) whereby said cylindrical groove cam (401) moves up or down, whereby said plunge rod (203) moves up or down, and said push and pull rod (105) moves forward or in reverse, and when the push and pull rod (105) moves forward, it pushes said driving rods (104) of said bar linkage and said coupling rods (103), and said claw arms (101) are expanded outwardly, and when the push and pull rod (105) reverses its motion, said driving rods (104) and said coupling rods (103) force said claw arms (101) to contract inwardly, whereby the distance between the claw arms (101) is adjusted to fit the specification of each bag, and when said driving roller (112) of said feeding means gears said bar linkage, said claws (106) of said bar linkage open and release each bag and close at a successive station.

2. The apparatus mechanism for bagging machine according to claim 1 wherein said worm mechanism is driven by a motor.

* * * * *